United States Patent [19]

Kitamura

[11] Patent Number: 4,466,328

[45] Date of Patent: Aug. 21, 1984

[54] MUSIC BOX FOR PLAYING MUSIC WITH DISK OR CARD AS MEDIUM

[75] Inventor: Yoshio Kitamura, Nagano, Japan

[73] Assignee: Kabushiki Kaisha Sankyo Seiki Seisakusho, Nagano, Japan

[21] Appl. No.: 349,552

[22] Filed: Feb. 17, 1982

[30] Foreign Application Priority Data

Feb. 20, 1981 [JP] Japan ..... 56-22136[U]
Aug. 7, 1981 [JP] Japan ..... 56-116728[U]

[51] Int. Cl.[3] ..... G10F 1/06
[52] U.S. Cl. ..... 84/98; 84/94 R
[58] Field of Search ..... 84/94–101

[56] References Cited

U.S. PATENT DOCUMENTS 558,442 4/1896 Vernaz ..... 84/98
581,981 5/1897 Cuendet ..... 84/98
638,524 12/1899 Schluss ..... 84/98
3,559,525 2/1971 Fishbein ..... 84/98
3,691,286 9/1972 Komatsu et al. ..... 84/101

*Primary Examiner*—Lawrence R. Franklin
*Attorney, Agent, or Firm*—Sughrue, Mion, Zinn, Macpeak and Seas

[57] ABSTRACT

A music box for playing music with a disk or a card as a medium has an improved ratchet unit for driving a vibrating reed assembly having a plurality of vibrating reeds. The ratchet unit has two arcuate shaped spacers which fit inside circular holes of a plurality of ratchets having teeth so that the teeth are guided by arcuate shaped grooves in the spacers. A hollow cylindrical member is then inserted between the spacers and a driving shaft is inserted into the hollow cylindrical member for driving the medium. A braking member is then inserted between the hollow cylindrical member and the ratchets to prevent the ratchets from being displaced due to external vibrations. The ratchet unit can be readily assembled and easily adapted to conventional music boxes.

12 Claims, 16 Drawing Figures

MUSIC BOX FOR PLAYING MUSIC WITH DISK OR CARD AS MEDIUM

BACKGROUND OF THE INVENTION

1. Field of the Invention

The present invention relates to a music box ("orgel") which plays music with a disk or card as a mudium having an improved mechanism for rotatably supporting ratchets which are turned by the medium to flip vibrating reeds.

2. Description of the Prior Art

A disk or card type music box is known in the art. For instance, as shown in FIGS. 3 and 7 in the specification of U.S. Pat. No. 3,559,525, ratchets are rotatably mounted on a shaft 22. The shaft 22 is rotatably supported by side plates 20 which are fixedly secured to both ends of a frame 19. Washers 24 and screws 25 are used to prevent the shaft from coming off. The ratchets 17 are equally spaced from one another by protruded spacers 45 formed on the frame 19. In assembling the ratchets, the ratchets are mounted on the shaft so that each ratchet is positioned between the spacers. Accordingly, it is absolutely necessary to use a frame which is designed only for the ratchets being used which lowers productivity. Furthermore, assembling the ratchets is hard since it is difficult to align the ratchets with the vibrating reeds and to support the ratchets. The conventional music box is therefore disadvantageous in several respects.

SUMMARY OF THE INVENTION

In view of the foregoing, an object of the present invention is to provide a music box for playing music with a disk or card as a medium in which the ratchets are formed into one unit which can replace the drum unit of a conventional music box. The ratchet unit can be produced on a large scale and a conventional frame, drive source and so on compatible therewith can also be manufactured on a large scale. Therefore, the assembling efficiency and productivity is improved.

A further object of the invention is to provide a music box for playing music having a rotary disk in which a member for applying a braking force to ratchets is arranged between the shaft and the ratchets to prevent the displacement of the ratchets due to vibration so that the teeth of the ratchets are operated by the pins of the rotary disk with predetermined timing and the music can be played with high reliability.

DESCRIPTION OF THE PREFERRED EMBODIMENTS

Figure 1:
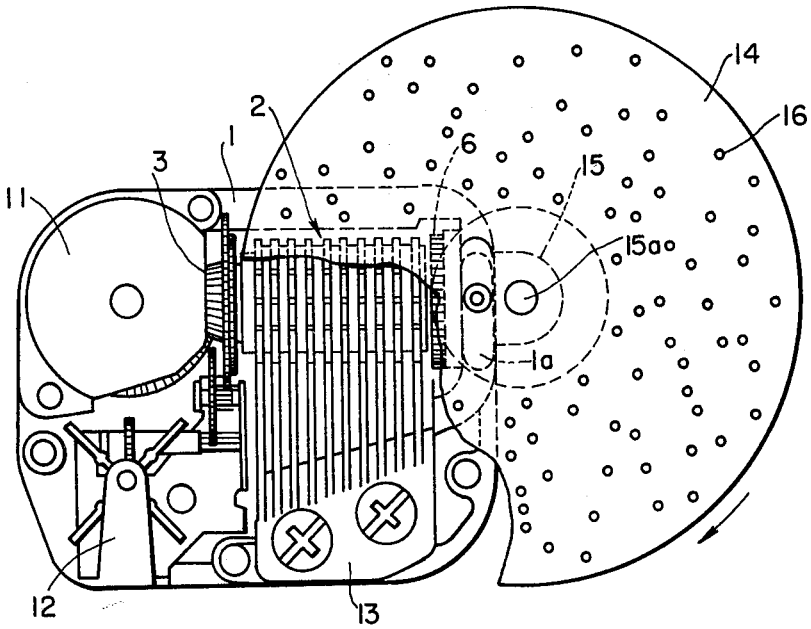
FIG. 1 is a plane view of a disk type music box of the invention.

A disk type music box which is played with a disk will first be described with reference to FIGS. 1 through 4. The music box, as shown in FIG. 1, comprises a frame 1 and a housing 11 incorporating a coil spring type drive source, a wind governor 12, a ratchet unit 2, a vibrating reed assembly 13 and a rotary disk 14 all of which are mounted on the frame 1. The frame 1, the housing 11 and the wind governor 12 are substantially similar to those of a conventional music box which is produced on a large scale. The reeds of the reed assembly 13 are abutted against the ratchets 3 of the ratchet unit 2.

Figure 2:
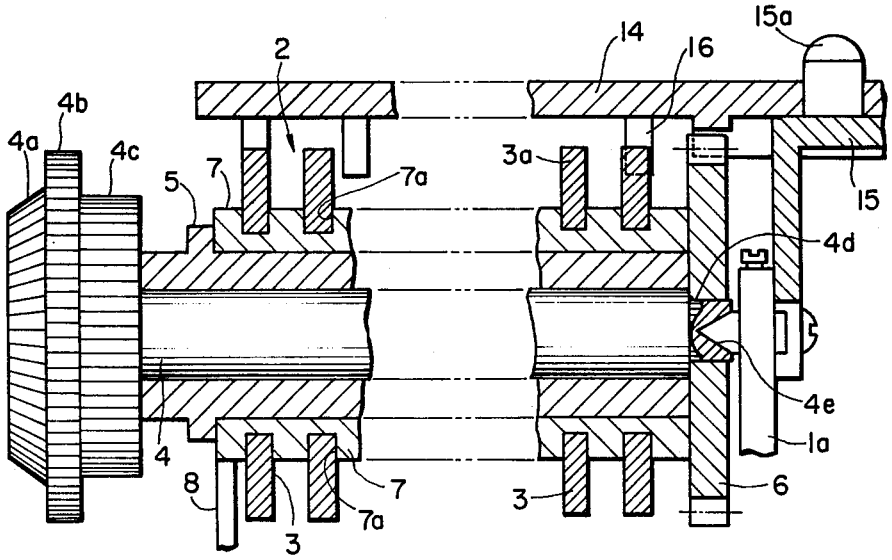
FIG. 2 is a sectional view of the essential components of a ratchet unit and a disk of one embodiment of the invention.
Figure 3:
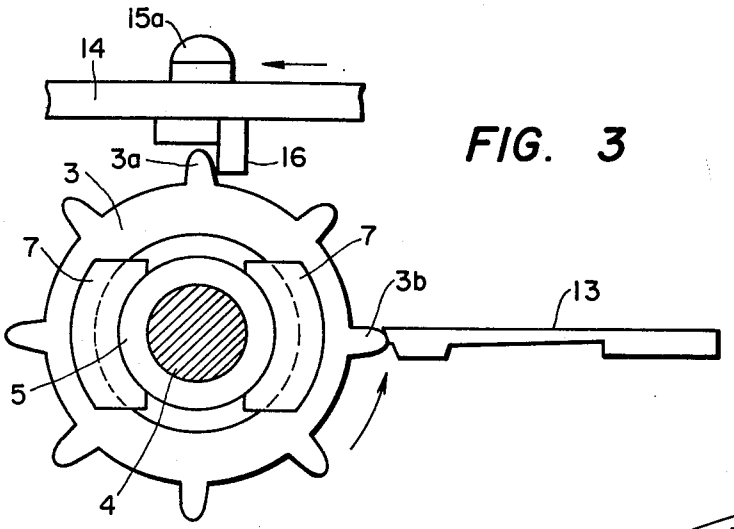
FIG. 3 is a side view, partly in section, of the components shown in FIG. 2.
Figure 4:
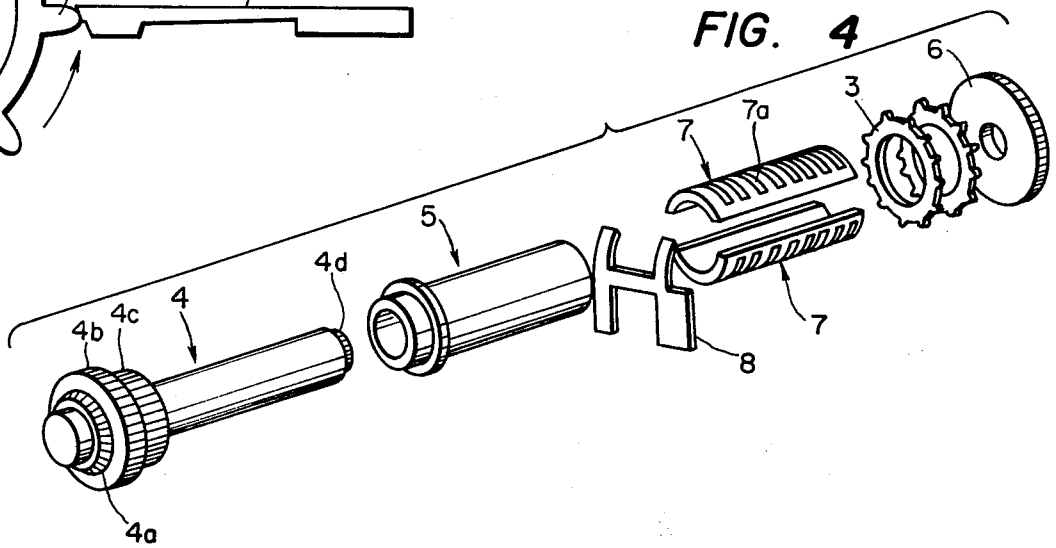
FIG. 4 is an exploded perspective view of the ratchet unit of FIGS. 2 and 3.

The ratchet unit 2, as shown in FIGS. 2 through 4, has a shaft 4 which has gears 4*a*, 4*b* and 4*c* at one end thereof. The shaft 4 is inserted into a hollow rotary sleeve 5. The other end portion 4*d* of the shaft 4 is knurled and is fitted into a gear 6. A pivot bearing hole 4*e* is formed in the end face of the other end portion 4*d* of the shaft 4. Two spacers 7 are placed on the outer wall of the hollow rotary sleeve 5. The gear 6 is engaged with a gear of the disk 14.

The aforementioned ratchets 3 are embedded in the spacers 7. A spacer stopping plate 8 is provided at one end of the spacers 7 to prevent the spacers from rotating and the spacer stopping plate 8 is secured to the frame 1. The ratchet unit 2 is made up of the shaft 4, the spacers 7, the gear 6 and the ratchets 3.

Each of the ratchets 3 is annular and has a round hole at its center. A plurality of teeth or pawls 3*a* are formed on the outer wall of each of the ratchets 3.

The spacers 3 are arcuate in section and can be freely inserted into the annular ratchets 3. A plurality of arcuate grooves 7*a* are cut in the outer walls of the spacers 7 in such a manner that they are parallel with each other. The spacers 7 are coupled to the ratchets 3 with the bottoms of the arcuate grooves 7*a* being brought into contact with the inner walls of the ratchets 3.

A bearing member 1*a* is provided at one side of the frame 1 and a disk supporting stand 15 is fixedly secured to the bearing member 1*a*. The disk 14 is rotatably fitted on the supporting shaft 15*a* which is provided on the disk supporting stand 15. The aforementioned gear of the disk 14 which is engaged with the gear 6 is formed on the lower surface of the disk 14. Furthermore, a plurality of pins 16 are provided on the lower surface of the disk 14 in a predetermined pattern according to the musical song to be produced. The pins 16 are set so as to abut against the teeth 3*a* of the ratchets 3.

The music box is assembled as follows. First, the spacers 7 are put together, with the grooves 7*a* facing outward. The spacers 7 are then inserted into the round holes of the ratchets 3. Then, the ratchets 3 are engaged with the respective grooves 7*a*. The hollow rotary sleeve 5 is positioned between the spacers 7 so that the ratchets are positively positioned in the grooves 7*a*. The shaft 4 is then inserted into the hollow rotary sleeve 5. The other end portion 4*d* of the shaft 4 is press-fitted into the gear 6. Thus, one ratchet unit has been assembled.

The ratchet unit is mounted at the position on the frame 1, where, in the case of a conventional music box produced on a large scale, its drum is rotatably mounted. A pivot shaft 17 is secured to the bearing member 1*a* and is then engaged with the pivot shaft hole formed in the end face of the shaft 4. The disk supporting stand 15 is secured to the bearing member 1*a* on the frame 1 and the disk 14 is fitted on the supporting shaft 15*a*. The annular inner surface of each ratchet 3 and the bottom of the grooves 7*a* formed in each spacer 7 may be modified so as to reduce the contact areas thereof to decrease the frictional resistance.

When, in the music box thus assembled, the drive source in the housing 11 is energized, the shaft 4 is rotated through the gear 4*a* and the wind governer is rotated through the gear 4*b*. The rotation of the shaft 4 is transmitted through the gear 6 to the disk 14 to turn the latter 14. As the disk 14 is turned, the pins 16 push teeth 3*a* of the ratchets 3 so that other teeth 3*b* of the ratchets 3 fillip the vibrating reeds to play the music.

Figure 5:
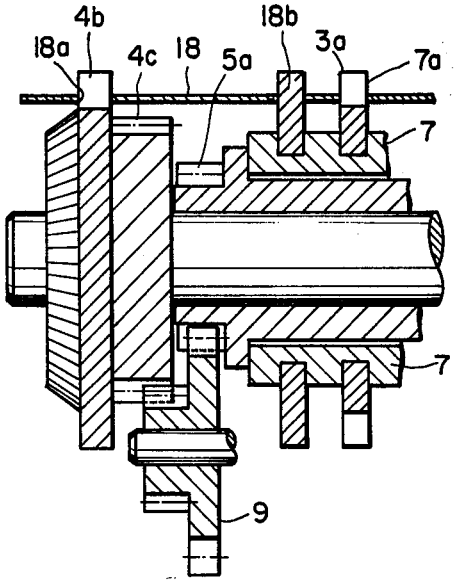
FIG. 5 is a sectional front view showing the essential components of a ratchet unit and a card in the card type music box.
Figure 7:
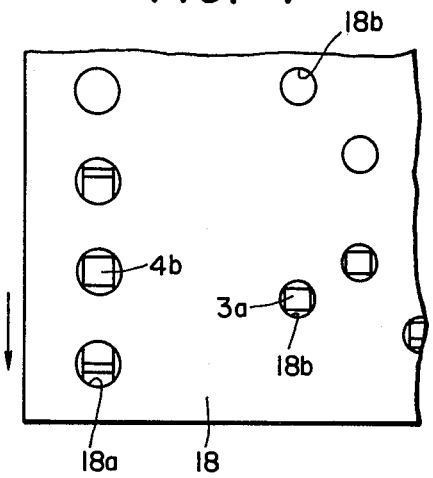
FIG. 7 is a plane view of the card shown in FIGS. 5 and 6.
Figure 6:
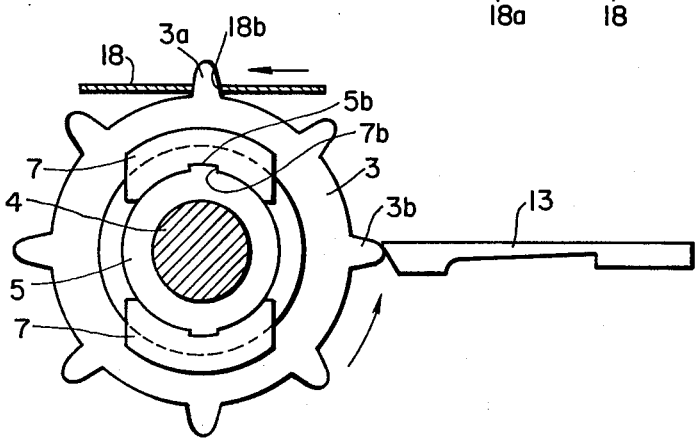
FIG. 6 is a sectional side view of the components shown in FIG. 5.

FIGS. 5 through 7 show a card type music box wherein the ratchets 3 are turned by a card 18. A gear 5*a* is formed in the outer wall of one end portion of the above-described hollow rotary shaft 5. The gear 5*a* is engaged with a relay gear 9 which is engaged with the gear 4*c* (FIG. 2).

It should be understood that the gear 4*c* of the shaft 4 is not required when the ratchets 3 of the music box of the invention are not turned by the card 18. In the card type music box, the hollow rotatory shaft 5 and the spacers 7 are so modified as to have protrusions 5*b* and recesses 7*b*, respectively, so that the shaft 5 and the spacers 7 are engaged with one another through the protrusions 5*b* and the recesses 7*b*. Therefore, the spacers 7 are turned at a higher speed than the speed of rotation of the shaft 4. In this music box, the spacer stopping plate 8 is not employed.

As shown in FIG. 7, the card 18 has a plurality of card feeding holes 18*a* which are formed in one edge portion of the card 18 at equal intervals. A plurality of holes 18*b* are formed in the entire card 18 in such a manner that the distance, in the lateral direction of the card, between adjacent holes 18*b* is equal to the distance between adjacent ratchets. The holes 18*b* are spaced in the longitudinal direction of the card according to the musical song to be produced. The teeth of the gear 4*b* are inserted into the card feeding holes 18*a* like a sprocket to feed the card 18.

In the card type music box, the card 18 is fed by the gear 4*b* at an equal speed and the ratchets 3 are turned through the gear 4*c*, the relay gear 9, the gear 5*a* and the spacers 7 while the teeth 3*a* are kept in contact with the lower surface of the card 18. As the card is fed, the hole 18*b* reaches the tooth 3*a* whereupon the latter tooth 3*a* is inserted into the hole 18*b*. Accordingly, the tooth 3*a* is turned by the card to cause another tooth 3*b* to fillip the vibrating reed 13.

The above-described card type music box may be modified as follows. Two ratchet units are set one above the other and the gears 4*b* of each ratchet unit are engaged with each other while the teeth of the ratchets 3 are engaged with one another. The upper ratchet unit is then engaged with the card and the vibrating reeds are filliped with the teeth of the lower ratchet unit.

Figure 8:
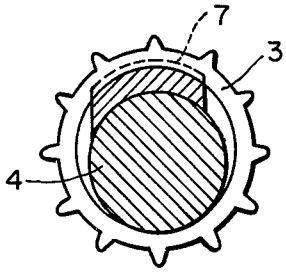
FIG. 8 is an explanatory diagram showing another embodiment of the ratchet unit of the invention.

In the above-described embodiment, two spacers 7 are employed, however, the ratchets may be held at equal intervals with one spacer 7 as shown in FIG. 8. The hollow rotary shaft 5 may therefore be omitted.

Figure 9:
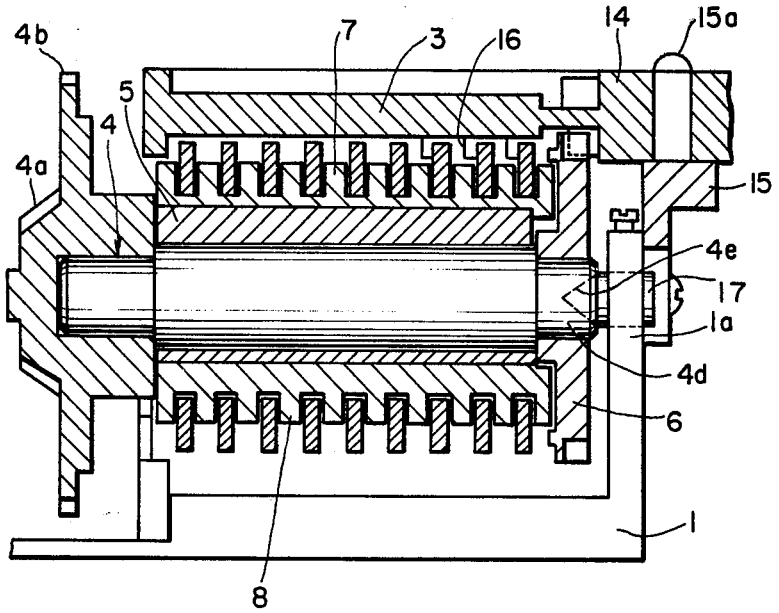
FIG. 9 is a sectional front view showing the essential components of a ratchet unit and a rotary disk of another embodiment of the invention.
Figure 10:
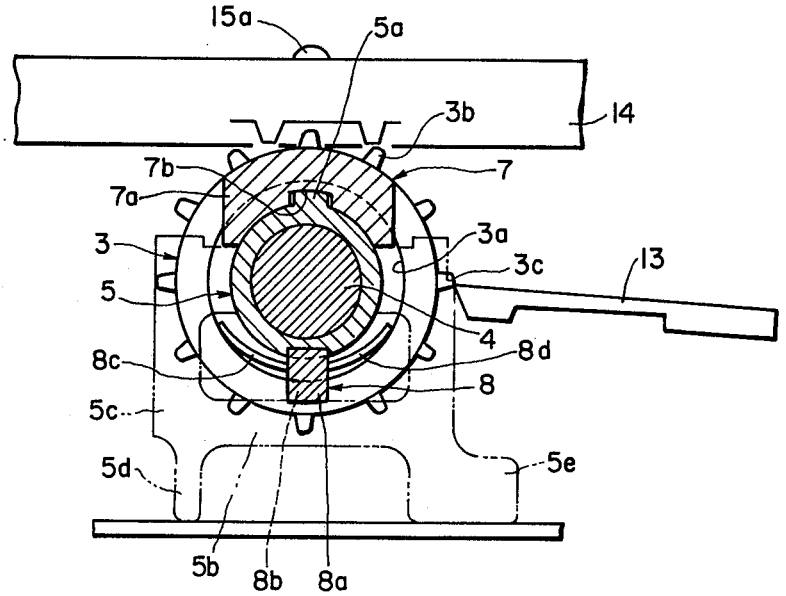
FIG. 10 is a cross-sectional view of the components shown in FIG. 2.
Figure 11:
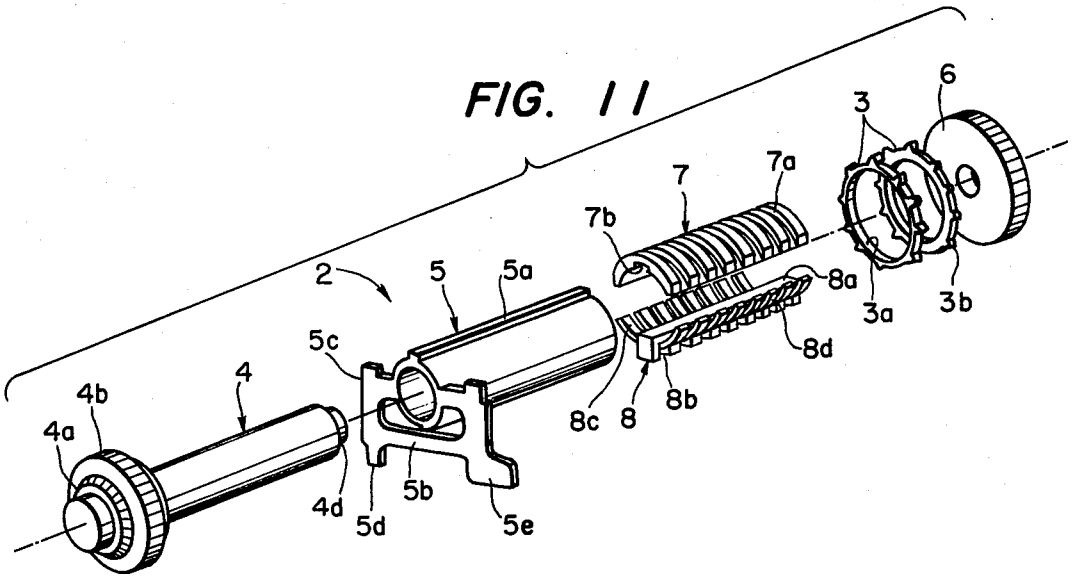
FIG. 11 is an exploded perspective view of the ratchet unit of FIGS. 9 and 10.

A further embodiment of the present invention is shown in FIGS. 9, 10 and 11. The ratchet unit shown in these figures is very similar to the one shown in FIGS. 2–4. In the ratchet unit of FIGS. 9–11, the shaft 4 has only 2 gears, 4*a* and 4*b*.

A spacer 7 and a member 8 for applying a braking force to the ratchets 3 are placed on the outer wall of the sleeve 5. The ratchets 3 are put on the spacer 7 and the member 8. The sleeve has a strip-shaped protrusion 5*a* which is formed on the outer wall and a groove 5*b* which is also formed in the outer wall. The protrusion 5*a* and the groove 5*b* are extended in the axial direction of the sleeve 5 and are diametrically opposed to each other. A stopper plate 5*c* is formed at one end of the sleeve 5 to prevent the sleeve 5 fromrotating. The stopper plate 5*c* has legs 5*d* and 5*e* which are set on the frame 1.

As in the previous embodiments, each of the ratchets 3 is annular and has a round hole 3*a* at the center. A plurality of teeth 3*b* are formed on the outer wall of each of the ratchets 3. The spacer 7 is arcuate in section and can be freely inserted into the ratchets 3. A plurality of arcuate grooves 7*a* are formed in the outer wall of the spacer 7 in such a manner that they are parallel with one another. The bottoms of the grooves 7*a* serve as guide surfaces for the inner walls of the ratchets 3 so that the ratchets 3 fit in the grooves 7*a*.

A groove 7*b* is cut in the inner wall of the spacer 7 in such a manner that it is extended in the axial direction and is engaged with the protrusion 5*a* of the sleeve 5. The aforementioned stopper plate 5*c* may be formed integral with the spacer 7.

The member 8 for applying a braking force to the ratchets 3 comprises an elongated spacer 8*a* and comb-shaped leaf springs 8*c* and 8*d* which are formed on both sides of the elongated spacer 8*a* respectively and are integral with the elongated spacer 8*a*. The positions of the leaf springs 8*c* and 8*d* correspond to the positions of the arcuate grooves 8*b* which are formed in parallel in the outer half of the elongated spacer 8*a*, the inner half of which is inserted into the groove 5*b* of the sleeve 5. Similarly as in the case of the grooves 7*a*, the arcuate grooves 8*b* are engaged with the ratchets 3. The springs 8*c* and 8*d* are slidably in contact with the inner walls of the round holes 3*a* of the ratchets.

The aforementioned embodiments of the music box thus described is assembled as follows. The spacers 7 and the braking member 8 for applying a braking force to the ratchets are put together so that the arcuate grooves 7*a* and 8*b* faced outward. The braking member 8 is then inserted into the round holes 3*a* of the ratchets 3 so that the ratches 8 fit into the grooves 7*a* and 8*b*. The sleeve 5 together with the shaft 4 is then inserted between the spacer 7 and the braking member 8 so that the ratchets 3 are securely positioned in the arcuate grooves 7*a* and 8*b*. Thereafter, the other end portion 4*c* of the shaft 4 is press-fitted into the gear 6. Thus, the ratchet unit 2 of the present embodiment has been assembled.

The ratchet unit 2 is mounted on the frame 1. A pivot shaft 17 is secured to the bearing member 1*a* and is then engaged with the pivot bearing hole 4*e* formed in the end face of the shaft 4.

In the music box thus assembled, when the drive source in the casing 11 is energized, the shaft 4 is rotated through the gear 4*a* and the wind governor is rotated through the gear 4*b*. The rotation of the shaft 4 is transmitted through the gear 6 to the disk 14 to turn the latter 14. As the disk 14 is turned, the pins 16 push teeth 3*b* of the ratchets 3 so that other teeth 3*c* (FIG. 10) fillip the reeds of the vibrating reed assembly 13 to play the music. The ratchets whose teeth are not yet pushed by the pins 16 are positioned in place because they are held by the leaf springs 8*c* and 8*d* of the braking member 8 which are slidably in contact with the ratchets. As described above, a plurality of ratchets can be braked by the single braking member 8 merely by adding the leaf springs to the elongated spacer 8*a* adapted to position the ratchets without increasing the number of components. As the leaf springs are slidably in contact with the ratchets, application of the braking force can be selected as desired.

Figure 12:
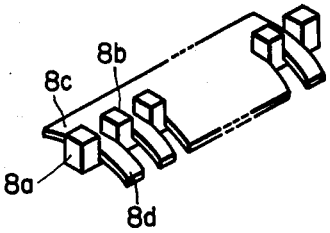
FIGS. 12–14 are perspective views showing other embodiments of a member adapted to apply a braking force to ratchets.
Figure 13:
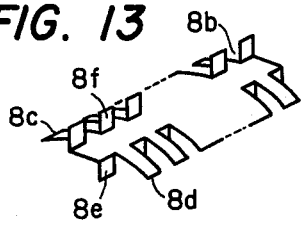
Figure 14:
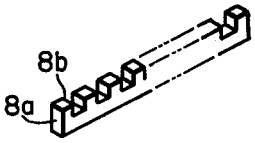

FIGS. 12 through 14 show other examples of the braking member 8. In the example shown in FIG. 5, the comb-shaped leaf springs 8*c*, 8*d*, are formed only on one side of the braking member 8. The other side of the braking member 8 has no cuts formed in the arcuate plate thereof. In the example shown in FIG. 13, a piece of metal plate is used to form the leaf springs 8*c* and 8*d*. Bent pieces 8*e* are inserted into the groove 5*b* and bent pieces 8*f* form the grooves with which the ratchets are engaged. In the example shown in FIG. 14, the elongated space 8*a* is made of elastic frictional material such as rubber which applies a braking force to the ratchets. As is apparent from the above-described examples, the braking member can be made of a metal sheet or material such as synthetic resin or rubber. This means that a wide range of materials is employable in production. As the music box is so designed that the ratchets are shifted to one side by the springs, the dimensional tolerance can be set relatively large and the number of components requiring high accuracy is less which improves productivity.

Figure 15:
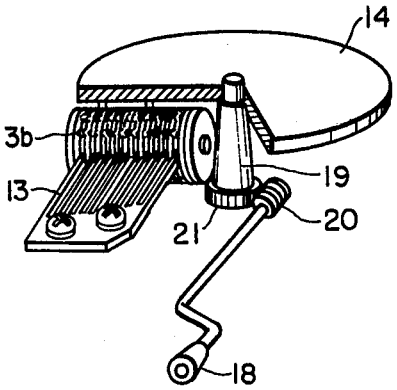
FIG. 15 is a perspective view showing one modification of the music box in which the disk is turned by a handle.
Figure 16:
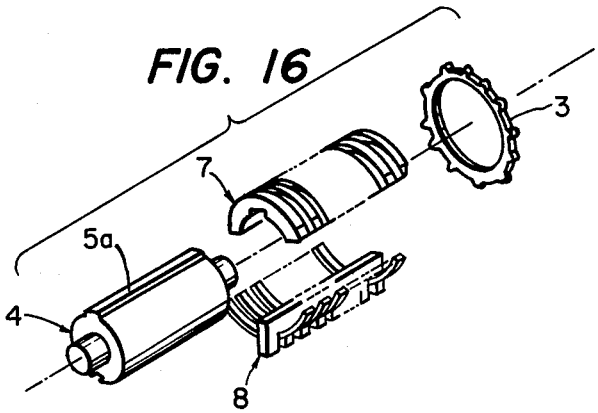
FIG. 16 is an exploded perspective view of another embodiment of the ratchet unit of the invention.

In the above-described embodiments, the disk is turnd by the coil spring type drive source. However, an electric motor may be employed as the drive source. Furthermore, the music box may be so modified that, as shown in FIG. 15, a drive shaft 19 is turned through a worm 20 and a gear 21 by a handle 18 so that the disk 14 on the drive shaft 19 is turned to play the music. In this case, the shaft 4 and the sleeve 5 may be integrally formed as shown in FIG. 9. If the shaft 4 is secured to the bearing member so that it cannot be turned, then the aforementioned stopper plate may be omitted in the case of FIG. 16.

The single braking member is incorporated in the ratchet unit as described above. Therefore, the ratchet unit is small in size, small in weight and fine in external appearance. Furthermore, the braking member applies braking force to the ratchets in the radial direction and therefore the postures of the ratchets are never affected by vibration or the like. Thus, the disk type music box according to the present invention can play good quality music.

The music box of the present invention can be produced on a large scale with a ratchet unit as described herein used instead of the drum unit of conventional music boxes. Thus, the existing equipment for mass production can be used as it is which results in the provision of music boxes using disks or cards which are considerably low in manufacturing cost. As the ratchet unit is provided by positioning a plurality of ratchets on the spacers, the ratchet unit can be readily positioned on the rotary shaft by means of the spacers. Therefore, the drum unit can be readily replaced by the ratchet unit. Furthermore, the disk type music box can be changed into the card type music box readily by removing the spacer stopping plate. As the ratchet unit is substantially equal in size to the drum unit and is replaceable, the music box can be readily miniaturized. Furthermore, similarly as in the conventional drum type music box, the music box of the present invention can find a wide range of application.

I claim:

1. A music box for playing music with a disk or card as a medium, comprising:

a vibrating reed assembly having a plurality of vibrating reeds therein;

a ratchet unit, said vibrating reed assembly and said ratchet unit being supported on a frame, said vibrating reed assembly being engaged with a plurality of ratchets in said ratchet unit, said plurality of ratchets being turned by said medium and each being annular and having teeth on an outer wall thereof;

said ratchet unit also having spacer means having a plurality of parallel grooves in an outer wall thereof, said ratchets fitting into said grooves with bottoms of said grooves forming guide surfaces for inner walls of said ratchets, said spacer means being freely insertable into said ratchets; and an elongated cylindrical member, said elongated cylindrical member being inserted between said spacer means inserted in said ratchets so as to position said ratchets in said grooves formed in said outer walls of said spacers.

2. The music box claimed in claim 1, further comprising a braking member for applying a braking force to said ratchets, said braking member being located between said elongated cylindrical member and said ratchets.

3. The music box claimed in claim 1, wherein said spacer means includes two spacers positioned so as to be diametrically opposed to each other, one of said two spacers being a braking member and being adapted to apply a braking force to said ratchets.

4. The music box claimed in claim 3, wherein said two spacers and said grooves are arcuate in section.

5. The music box claimed in claim 3, wherein said spacer which serves as a braking member has a plurality of comb-shaped leaf springs formed so as to be in sliding contact with said ratchets.

6. The music box claimed in claim 1, wherein said elongated cylindrical member is hollow and further comprising a drive shaft which fits into said cylindrical member and drives said medium.

7. The music box claimed in claim 6, further comprising means for preventing rotation of said elongated cylindrical member.

8. The music box claimed in claim 6, wherein said spacer means has protrusions which fit into recesses formed in said elongated cylindrical member, said elongated cylindrical member being turned at a speed higher than a speed of movement of said medium, said teeth of said ratchets being allowed to enter holes formed in said medium.

9. The music box claimed in claim 6, wherein said elongated cylindrical member has at least one first gear formed on an end thereof, an opposite end of said cylindrical member being knurled so as to be fittable into a second gear.

10. The music box claimed in claim 1, wherein said elongated cylindrical member has three first gears one of which drives a wind governor and another of which drives said elongated cylindrical member.

11. The music box claimed in claim 1, wherein said elongated cylindrical member has a strip-shaped protrusion and a groove formed on an outer wall thereof in an axial direction, said strip-shaped protrusion and said groove being diametrically opposed.

12. The music box claimed in claim 1, wherein said elongated cylindrical member drives said medium.

* * * * *